US005577488A

United States Patent [19]

Sato et al.

[11] Patent Number: 5,577,488

[45] Date of Patent: Nov. 26, 1996

[54] AIR-FUEL RATIO SENSOR DETERIORATION-DETECTING SYSTEM FOR INTERNAL COMBUSTION ENGINES

[75] Inventors: Ryuji Sato; Kojiro Tsutsumi; Toshitaka Hachiro; Hiroshi Kawaguchi; Sachito Fujimoto, all of Wako, Japan

[73] Assignee: Honda Giken Kogyo Kabushiki Kaisha, Tokyo, Japan

[21] Appl. No.: 549,119

[22] Filed: Oct. 27, 1995

[30] Foreign Application Priority Data

Oct. 28, 1994 [JP] Japan ..... 6-289161

[51] Int. Cl.[6] ..... F02D 41/14

[52] U.S. Cl. ..... 123/688; 60/276

[58] Field of Search ..... 123/688, 690; 60/274, 276; 73/23.32, 118.1

[56] References Cited

U.S. PATENT DOCUMENTS

Re. 33,942 6/1992 Katsuno et al. ..... 123/688 X
5,182,907 2/1993 Kuroda et al. ..... 123/688 X

FOREIGN PATENT DOCUMENTS 5-256175 10/1993 Japan .
6-74074 3/1994 Japan .

*Primary Examiner*—Tony M. Argenbright
*Attorney, Agent, or Firm*—Nikaido, Marmelstein, Murray & Oram LLP

[57] ABSTRACT

An air-fuel ratio sensor deterioration-detecting system for an internal combustion engine includes a catalytic converter arranged in the exhaust system, first and second air-fuel ratio sensors arranged in the exhaust system at respective locations upstream and downstream of the catalytic converter, and an ECU which calculates a value of a first control parameter, based on an output from the second air-fuel ratio sensor, and executes air-fuel ratio feedback control, based on the calculated value of the first control parameter. A value of a second control parameter to be used for calculating the value of the first control parameter is calculated based on the output from the second air-fuel ratio sensor. Whether the second air-fuel ratio sensor is deteriorated is determined based on the output from the second air-fuel ratio sensor. A value of at least one of the first and second control parameters is increased when a variation in the output from the second air-fuel ratio sensor is small during execution of the air-fuel ratio feedback control, and it is determined that the second air-fuel ratio sensor is deteriorated when the variation in the output from the second air-fuel ratio sensor is continuously small over a predetermined time period after the value of the at least one of the first and second control parameters has been increased.

6 Claims, 7 Drawing Sheets

FUEL INJECTION VALVE
INTERNAL COMBUSTION ENGINE
THREE-WAY CATALYST
O2
O2
CYL
NE
TW
TA
PBA
θ TH
INPUT CIRCUIT
C P U
MEMORY MEANS
OUTPUT CIRCUIT
ECU
1
2
3
4
5
5a
5b
5c
5d
6
7
8
9
10
11
12
13
14
16
17

A
B
S32
PAF1=0 ?
YES
NO
S33
PAF2←0
S38
PAF2←1
S34
CDLY1←TDR1
S39
CDLY1←TDL1
S35
KO2←KO2+PR
S40
KO2←KO2−PL
S36
EXECUTE LIMIT-CHECKING OF KO2
S37
CALCULATE KREF0 & KREF1
S28
EXECUTE LIMIT-CHECKING OF KREF2
RETURN
S22
PAF2=0 ?
S23
PAF1=0 ?
S24
CDLY1←TDR1
S25
KO2←KO2+I
S29
PAF1=1 ?
S30
CDLY1←TDL1
S31
KO2←KO2−I
S26
EXECUTE LIMIT-CHECKING OF KO2
S27
CALCULATE KREF2

CALCULATION OF PL & PR DOWNSTREAM SENSOR F/B CONTROL
S61
SVO2<SVREF ?
NO
YES
S62
PR←PR+DPL
S63
PR>PRMAX ?
NO
YES
S64
PR←PRMAX
S65
PL←PL−DPL
S66
PL<PLMIN ?
NO
YES
S67
PL←PLMIN
S68
PR←PR−DPR
S69
PR<PRMIN ?
NO
YES
S70
PR←PRMIN
S71
PL←PL+DPR
S72
PL>PLMAX ?
NO
YES
S73
PL←PLMAX
RETURN

AIR-FUEL RATIO SENSOR DETERIORATION-DETECTING SYSTEM FOR INTERNAL COMBUSTION ENGINES

BACKGROUND OF THE INVENTION

1. Field of the Invention

This invention relates to an air-fuel ratio sensor deterioration-detecting system for internal combustion engines, and more particularly to an air-fuel ratio sensor deterioration-detecting system of this kind, which detects deterioration of an air-fuel ratio sensor arranged in the exhaust system of the engine at a location downstream of a catalytic converter arranged therein.

2. Prior Art

To detect deterioration of an air-fuel ratio sensor arranged in the exhaust system of an internal combustion engine at a location downstream of a catalytic converter arranged therein, the following methods (1) to (3) are conventionally known:

(1) The air-fuel ratio of an air-fuel mixture supplied to the engine is forcedly changed from a rich value to a lean value or vice versa, by open-loop control of the air-fuel ratio (Japanese Laid-Open Patent Publication (Kokai) No. 5-256175).

(2) When an output from the downstream air-fuel ratio sensor shows a leaner value than a predetermined reference value and at the same time a variation in the output continuously remains within a predetermined range over a first predetermined time period, the air-fuel ratio of the air-fuel mixture is set to a richer value than a stoichiometric air-fuel ratio. Thereafter, if the output from the downstream air-fuel ratio sensor still shows a leaner value than the predetermined reference value and at the same time the variation in the output value continuously remains within the predetermined range over a second predetermined time period, it is determined that the downstream air-fuel ratio sensor is deteriorated (Japanese Laid-Open Patent Publication (Kokai) No. 6-74074).

(3) It is determined that the downstream air-fuel ratio sensor is deteriorated if the variation in the output from the downstream air-fuel ratio sensor continuously remains within a small range over a predetermined time period during execution of air-fuel ratio feedback control based on outputs from an air-fuel ratio sensor arranged upstream of the catalytic converter and the downstream air-fuel ratio sensor.

According to the above method (1), however, since the air-fuel ratio of the mixture is forcedly enriched or leaned by the open-loop control, the amount of generation of CO increases due to the enriching of the air-fuel ratio, or the amount of generation of NOx increases due to the leaning of the same.

Further, according to the above method (2) as well, the air-fuel ratio of the air-fuel mixture is forcedly enriched by the open-loop control, resulting in an increased amount of generation of CO, similarly to the method (1).

The method (3) does not cause degraded exhaust emission characteristics of the engine since the deterioration of the sensor is detected during execution of the air-fuel feedback control. However, the sensor output can sometimes remain close to a predetermined reference value for discriminating between rich and lean values, over the predetermined time period, even if the sensor is operating normally, resulting in a misjudgment that the sensor is deteriorated.

SUMMARY OF THE INVENTION

It is the object of the invention to provide an air-fuel ratio sensor deterioration-detecting system for internal combustion engines, which is capable of detecting deterioration of the downstream air-fuel ratio sensor without degrading exhaust emission characteristics of the engine, as well as capable of improving the accuracy of the detection.

To attain the above object, the present invention provides an air-fuel ratio sensor deterioration-detecting system for an internal combustion engine having an exhaust system, a catalytic converter arranged in the exhaust system, first and second air-fuel ratio sensors arranged in the exhaust system at respective locations upstream and downstream of the catalytic converter, first air-fuel ratio control parameter-calculating means for calculating a value of a first control parameter, based on an output from the second air-fuel ratio sensor, air-fuel ratio control means for executing air-fuel ratio feedback control such that an air-fuel ratio of an air-fuel mixture to be supplied to the engine is controlled based on the calculated value of the first control parameter, second air-fuel ratio control parameter-calculating means for calculating a value of a second control parameter to be used for calculating a value of the first control parameter, based on the output from the second air-fuel ratio sensor, and deterioration-determining means for determining whether the second air-fuel ratio sensor is deteriorated, based on the output from the second air-fuel ratio sensor.

The air-fuel ratio sensor deterioration-detecting system according to the invention is characterized by an improvement wherein:

the deterioration-determining means comprises increasing means for increasing a value of at least one of the first and second control parameters when a variation in the output from the second air-fuel ratio sensor is small during execution of the air-fuel ratio feedback control by the air-fuel ratio control means, and determining means for determining that the second air-fuel ratio sensor is deteriorated when the variation in the output from the second air-fuel ratio sensor is continuously small over a predetermined time period after the value of the at least one of the first and second control parameters has been increased.

Preferably, the increasing means increases the value of the at least one of the first and second control parameters when the output from the second air-fuel ratio sensor continuously remains within a predetermined range over a predetermined time period during execution of the air-fuel ratio feedback control by the air-fuel ratio control means.

Also preferably, the determining means determines that the second air-fuel ratio sensor is deteriorated when the output from the second air-fuel ratio sensor, which has been increased by the increasing means, continuously remains within a predetermined range over a predetermined time period.

Preferably, the air-fuel ratio sensor deterioration-detecting system includes zone-determining means for determining which of a plurality of predetermined zones the output from the second air-fuel ratio sensor falls in, and wherein the increasing means increases the value of the at least one of the first and second control parameters when the output from the second air-fuel ratio sensor continuously remains within one of the plurality of the predetermined zones over a predetermined time period.

Also preferably, the determining means determines that the second air-fuel ratio sensor is deteriorated when the output from the second air-fuel ratio sensor, which has been increased by the increasing means, continuously remains within one of the plurality of the predetermined zones over a predetermined time period.

The object of the invention can also be attained by an air-fuel ratio sensor deterioration-detecting system for an internal combustion engine having an exhaust system, a catalytic converter arranged in the exhaust system, first and second air-fuel ratio sensors arranged in the exhaust system at respective locations upstream and downstream of the catalytic converter, air-fuel ratio control parameter-calculating means for calculating a value of a control parameter, based on an output from the second air-fuel ratio sensor, air-fuel ratio control means for executing air-fuel ratio feedback control such that an air-fuel ratio of an air-fuel mixture to be supplied to the engine is controlled based on the calculated value of the control parameter, and deterioration-determining means for determining whether the second air-fuel ratio sensor is deteriorated, based on the output from the second air-fuel ratio sensor, characterized by a further improvement wherein:

the deterioration-determining means comprises increasing means for increasing the value of the control parameter when a variation in the output from the second air-fuel ratio sensor is below a predetermined value during execution of the air-fuel ratio feedback control by the air-fuel ratio control means, and determining means for determining that the second air-fuel ratio sensor is deteriorated when the variation in the output from the second air-fuel ratio sensor continuously remains below the predetermined value over a predetermined time period after the value of the control parameter has been increased.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
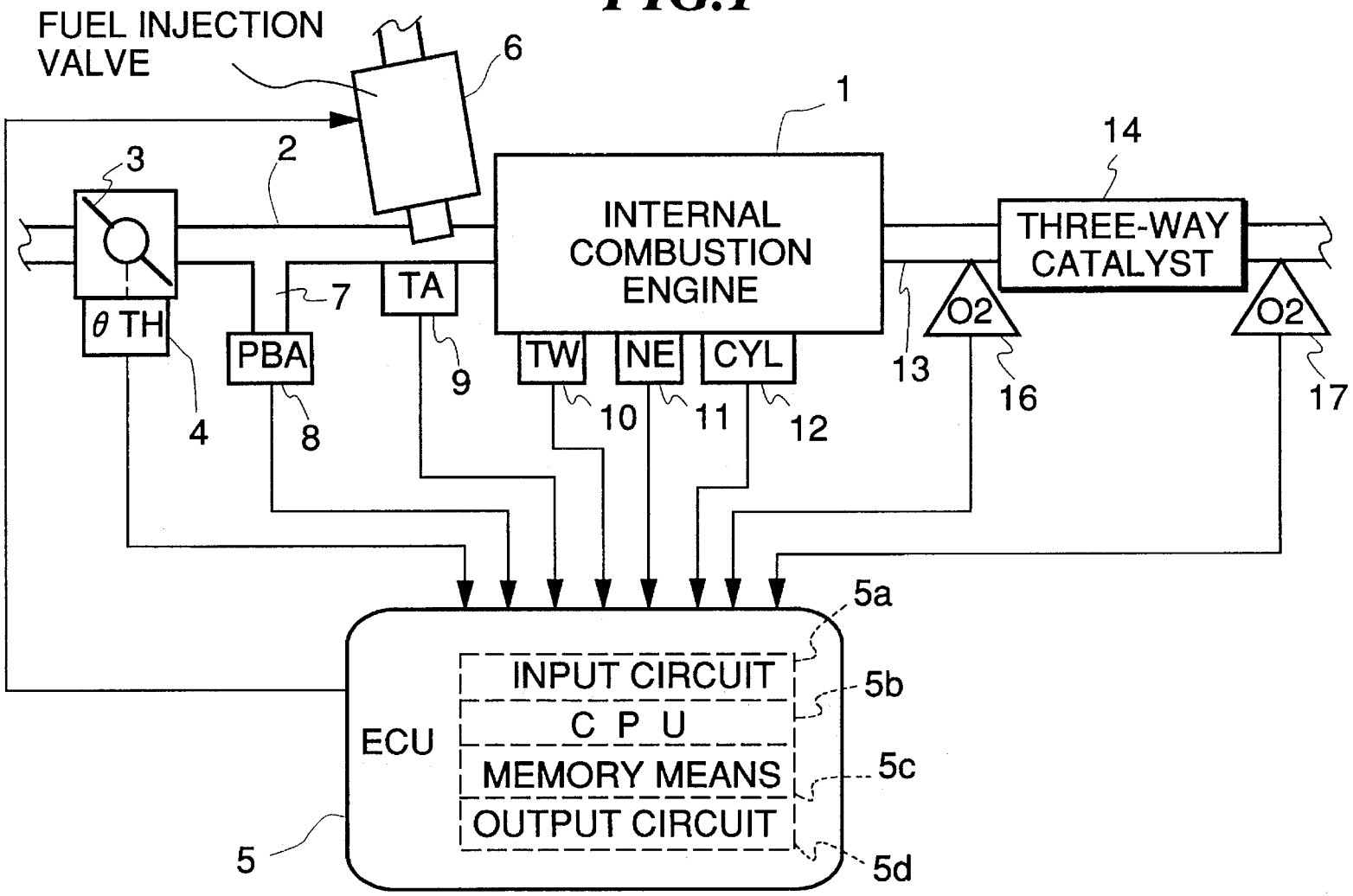
FIG. 1 is a block diagram showing the whole arrangement of an internal combustion engine and an air-fuel ratio sensor deterioration-detecting system therefor, according to an embodiment of the invention.

Referring first to FIG. 1, there is schematically shown the whole arrangement of an internal combustion engine and an air-fuel ratio sensor deterioration-detecting system therefor, according to an embodiment of the invention.

In the figure, reference numeral 1 designates an internal combustion engine (hereinafter referred to as "the engine"), which has an intake pipe 2 connected to the cylinder block thereof, across which is arranged a throttle valve 3. A throttle valve opening (θTH) sensor 4 is connected to the throttle valve 3 for generating an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location between the engine 1 and the throttle valve 3 and slightly upstream of an intake valve, not shown. Each fuel injection valve 6 is connected to a fuel pump, not shown, and electrically connected to the ECU 5 to have its valve opening period controlled by a signal therefrom.

On the other hand, an intake pipe absolute pressure (PBA) sensor 8 is connected to the intake pipe 2 via a conduit 7 at a location immediately downstream of the throttle valve 3 for sensing absolute pressure (PBA) within the intake pipe 2, and is electrically connected to the ECU 5 for supplying an electric signal indicative of the sensed absolute pressure PBA to the ECU 5. Further, an intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine which is filled with coolant, for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The NE sensor 11 generates a signal pulse (hereinafter referred to as "a TDC signal pulse") at each of predetermined crank angles whenever the crankshaft rotates through 180 degrees, while the CYL sensor 12 generates a signal pulse at a predetermined crank angle of a particular cylinder of the engine, both of the pulses being supplied to the ECU 5.

A three-way catalyst (catalytic converter) 14 is arranged in an exhaust pipe 13 connected to the engine 1, for purifying noxious components in exhaust gases from the engine, such HC, CO, and NOx. Oxygen concentration sensors 16 and 17 are arranged in the exhaust pipe 13 at respective locations upstream and downstream of the three-way catalyst 13 (hereinafter referred to as "the upstream O2 sensor 16" and "the downstream O2 sensor 17"), for detecting the concentration of oxygen present in exhaust gases at their respective locations and supplying electric signals indicative of the sensed oxygen concentration to the ECU 5.

The ECU 5 is comprised of an input circuit *5a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU") *5b*, memory means *5c* storing various operational programs which are executed by the CPU *5b* and for storing results of calculations therefrom, etc., and an output circuit *5d* which delivers driving signals to the fuel injection valves 6.

The CPU 5b operates in response to the above-mentioned signals from the sensors to determine operating conditions in which the engine 1 is operating, such as an air-fuel ratio feedback control region and air-fuel ratio open-loop control regions, and calculates, based upon the determined engine operating conditions, the valve opening period or fuel injection period TOUT over which the fuel injection valves 6 are to be opened, by the use of the following equation (1), in synchronism with generation of TDC signal pulses:

$$TOUT=Ti\times KO2\times K1+K2 \quad (1)$$

where Ti represents a basic value of the fuel injection period TOUT, which is determined according to the engine rotational speed NE and the intake pipe absolute pressure PBA. A map for determining the Ti value is stored in the memory means 5c.

KO2 represents an air-fuel ratio correction coefficient which is determined based on outputs from the upstream and downstream O2 sensors 16 and 17 when the engine 1 is operating in the air-fuel ratio feedback control region, while it is set to predetermined values corresponding to the respective air-fuel ratio open-loop control regions of the engine when the engine 1 is in the open-loop control regions.

K1 and K2 represent other correction coefficients and correction variables, respectively, which are set according to engine operating parameters to such values as optimize operating characteristics of the engine, such as fuel consumption and engine accelerability.

The CPU 5b supplies driving signals via the output circuit 5d to the fuel injection valves 6, based on the fuel injection period TOUT thus determined, to drive the fuel injection valves 6.

Figure 2A:
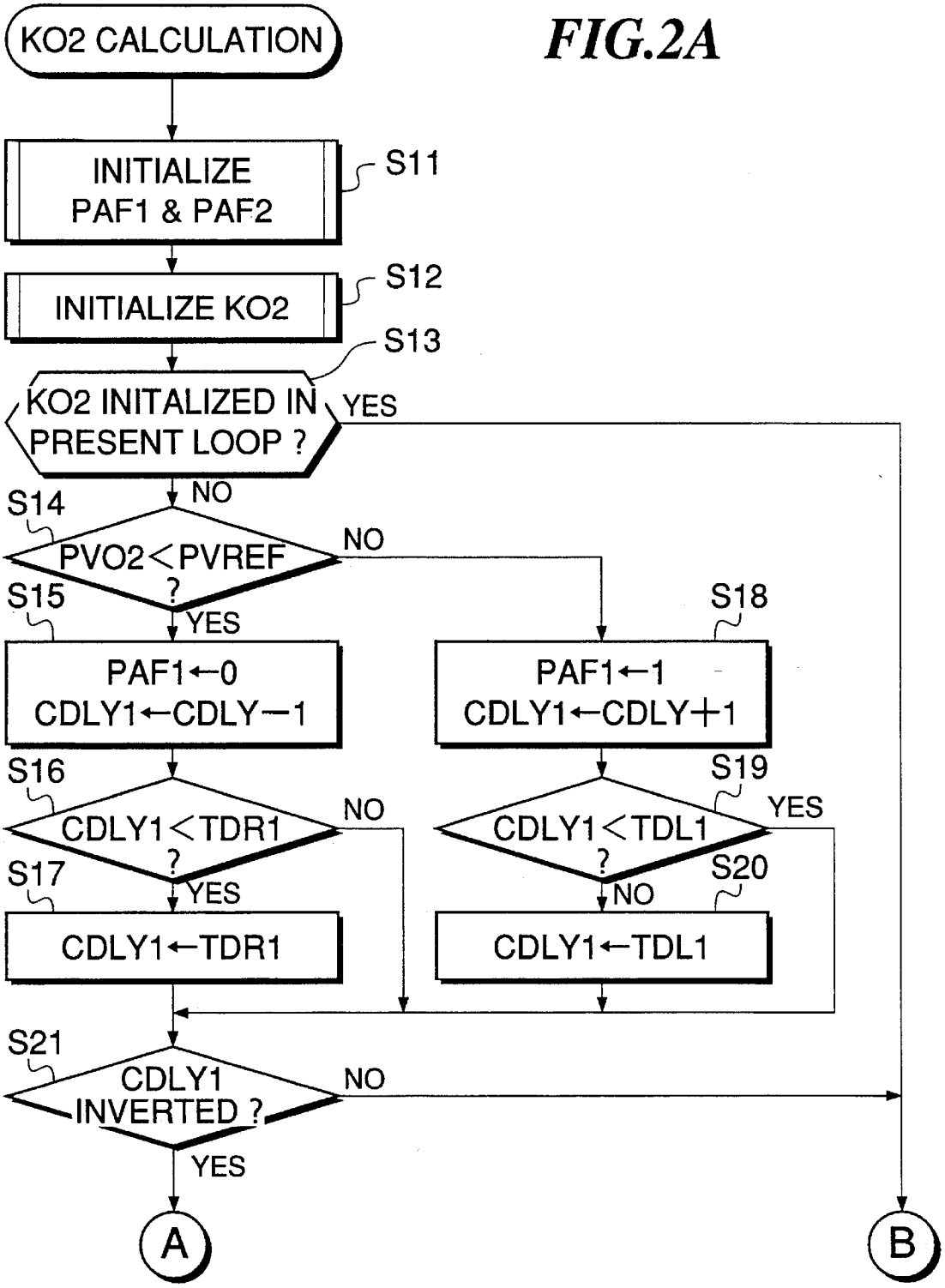
FIG. 2A is a flowchart showing a program for calculating an air-fuel ratio correction coefficient KO2.
Figure 2B:
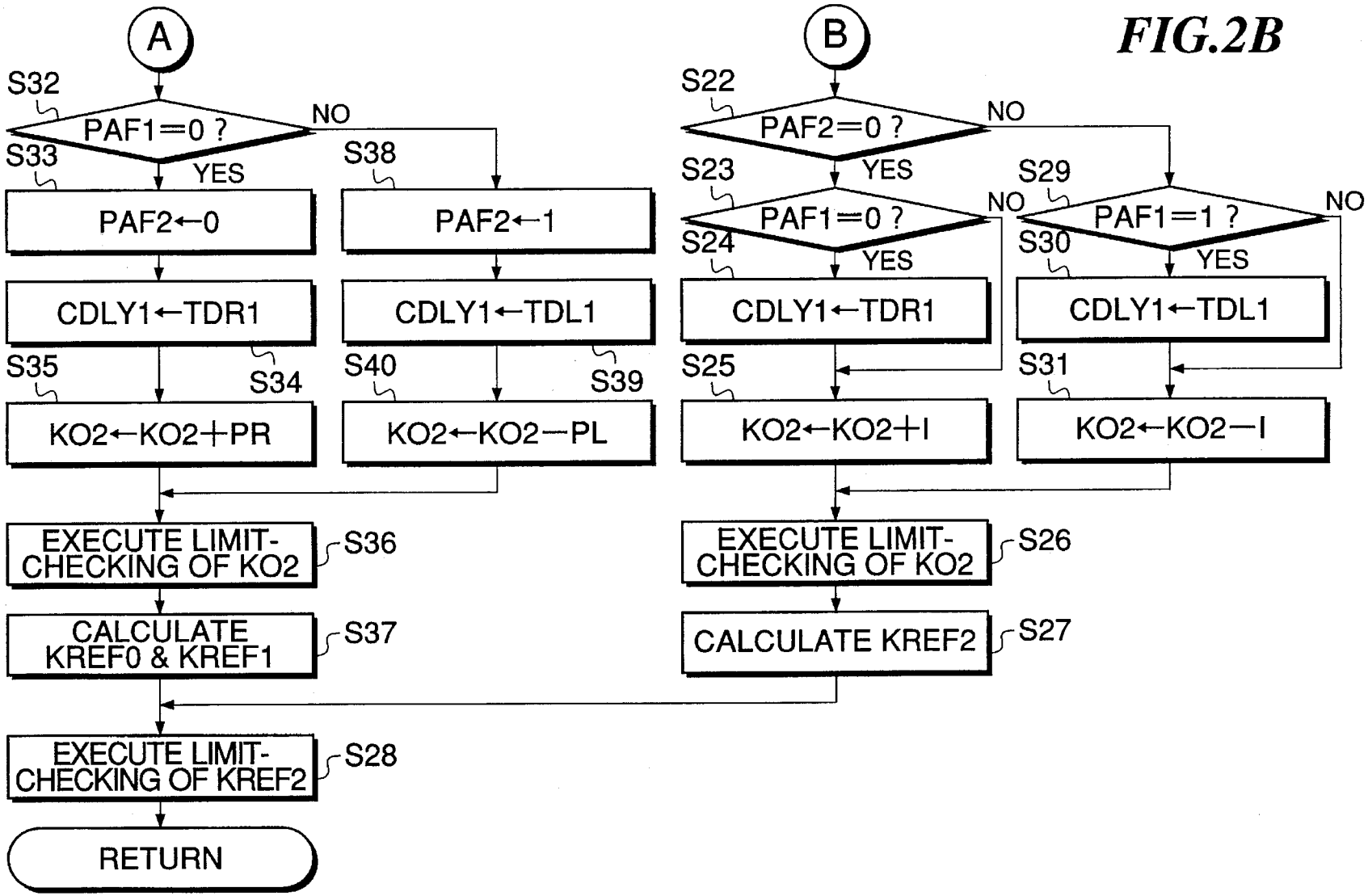
FIG. 2B is a continued part of the FIG. 2A flowchart.

FIG. 2A and FIG. 2B show a program for calculating the air-fuel ratio correction coefficient KO2 applied during 2-O2 sensor F/B control, i.e. air-fuel ratio feedback control based on the outputs from the upstream and downstream O2 sensors. According to this program, the air-fuel ratio correction coefficient KO2 is calculated based on output voltage PVO2 from the upstream O2 sensor 16 and output voltage SVO2 from the downstream O2 sensor 17 such that the air-fuel ratio of an air-fuel mixture supplied to the engine becomes equal to a stoichiometric value ($\lambda=1$). This program is executed by the CPU 5b at predetermined fixed time intervals (e.g. 5 msec) when the engine is operating in the air-fuel ratio feedback control region.

First, at a step S11, flags PAF1 and PAF2 are initialized. The flag PAF1 indicates lean and rich states of the output voltage PVO2 from the upstream O2 sensor 16, when set to "0" and "1", respectively, and the flag PAF2 indicates lean and rich states of the same after a predetermined delay time has been counted up by a counter CDLY1, referred to hereinafter, when set to "0" and "1" respectively. Then, at a step S12, the air-fuel ratio correction coefficient KO2 is initialized (e.g. set to an average value KREF thereof), followed by the program proceeding to a step S13.

At the step S13, it is determined whether or not the air-fuel ratio correction coefficient KO2 has just been initialized in the present loop. If the answer is negative (NO), the program proceeds to a step S14, wherein it is determined whether or not the upstream O2 sensor output voltage PVO2 is lower than a reference value PVREF (threshold value for determining whether the output voltage PVO2 is rich or lean). If the answer is affirmative (YES), i.e. if PVO2<PVREF, it is determined that the output voltage PVO2 from the upstream O2 sensor 16 shows a lean value, and then the flag PAF1 is set to "0" at a step S15, and at the same time the count value CDLY of the counter CDLY1 (set value: CDLY1) for counting a P-term generation delay time TDR1 or TDL1 is decremented by 1. More specifically, if PVO2<PVREF, the flag PAF1 is set to "0" and the count value CDLY of the counter CDLY1 is decremented by 1 to thereby obtain the set value CDLY1 whenever the present step is carried out.

Then, at a step S16, it is determined whether or not the set value CDLY1 is smaller than the predetermined delay time TDR1. If the answer is affirmative (YES), i.e. if CDLY1<TDR1 holds, the set value CDLY1 is reset to the delay time TDR1 at a step S17. On the other hand, if the answer to the question of the step S14 is negative (NO), i.e. if PVO2≧PVREF holds, which means that the output voltage PVO2 from the upstream O2 sensor 16 shows a rich value, the flag PAF1 is set to "1", and at the same time the count value CDLY is incremented by 1 at a step S18. More specifically, if PVO2≧PVREF holds, the flag PAF1 is set to "1" and the count value CDLY of the counter CDLY1 is incremented by 1 to thereby obtain the set value CDLY1 whenever the present step is carried out.

Then, at a step S19, it is determined whether or not the set value CDLY1 is smaller than the predetermined delay time TDL1. If the answer is negative (NO), i.e. if CDLY1≧TDL1 holds, the set value CDLY1 is reset to the delay time TDL1 at a step S20. If the answer to the question of the step S16 is negative (NO), i.e. if CDLY1≧TDR1 holds, the program skips over the step S17 to a step S21. Similarly, if the answer to the question at the step S19 is affirmative (YES), i.e. if CDLY1≧TDL1 holds, the program skips over the step S20 to the step S21.

At the step S21, it is determined whether or not the sign of the count value CDLY1 has been inverted. That is, it is determined whether or not the delay time TDR1 or TDL1 has been counted up after the output voltage PVO2 from the upstream O2 sensor 16 crossed the reference value PVREF. If the answer is negative (NO), i.e. if the delay time TDR1 or TDL1 has not elapsed, the program proceeds to a step S22, wherein it is determined whether or not the flag PAF2 has been set to "0". If the answer is affirmative (YES), it is determined at a step S23 whether or not the flag PAF1 has been set to "0". If the answer is affirmative (YES), it is judged that the air-fuel ratio has continuously been lean, so that the program proceeds to a step S24, wherein the set value CDLY1 is reset to the delay time TDR1, followed by the program proceeding to a step S25. On the other hand, if the answer to the question of the step S23 is negative (NO), it is judged that the delay time period has not elapsed yet after the output voltage PVO2 from the upstream O2 sensor 16 was inverted from a lean side to a rich side, i.e. after it crossed the reference value PVREF, so that the program skips over the step S24 to the step S25.

At the step S25, a present value of the air-fuel ratio correction coefficient KO2 is calculated by adding an integral term I to a value of the coefficient KO2 calculated in the immediately preceding loop, by the use of the following equation (2):

$$KO2=KO2+I \quad (2)$$

After execution of the step S25, limit-checking of the resulting value of the correction coefficient KO2 is performed in a known manner at a step S26, and then a value KREF2 (learned value of the correction coefficient KO2 used in starting the vehicle) is calculated at a step S27, followed by executing limit-checking of the resulting value KREF2 at a step S28. Thus, the present program is terminated.

On the other hand, if the answer to the question of the step S22 is negative (NO), i.e. if the flag PAF2 is set to "1", it is further determined at a step S29 whether or not the flag PAF1 is set to "1". If the answer is affirmative (YES), it is judged that the air-fuel ratio has continuously been rich, and then at a step S30, the set value CDLY1 is reset to the delay time TDL1 again, followed by the program proceeding to a step S31. On the other hand, if the answer to the question of the step S29 is negative (NO), it is judged that the delay time period has not elapsed yet after the output voltage PVO2 from the upstream O2 sensor 16 was inverted from the lean side to the rich side, so that the program skips over the step S30 to a step S31.

At the step S31, a present value of the correction coefficient KO2 is calculated by subtracting the integral term I from the immediately preceding value of the correction coefficient KO2, by the use of the following equation (3):

$$KO2=KO2-I \quad (3)$$

Then, the above steps S26 to S28 are carried out, followed by terminating the routine.

In this way, when the sign of the set value CDLY1 has not been inverted, the statuses of the flags PAF1 and PAF2 are checked to determine whether or not the output voltage PVO2 from the upstream O2 sensor 16 has been inverted from the lean side to the rich side or vice versa, and the correction coefficient KO2 is calculated based on results of the checking.

On the other hand, if the sign of the count value of the counter CDLY1 has been inverted, i.e. if the answer to the question of the step S21 is affirmative (YES), that is, if the delay time TDR1 or the delay time TDL1 has elapsed after the output voltage PVO2 from the upstream O2 sensor 16 was inverted from the lean side to the rich side or vice versa, the program proceeds to a step S32, wherein it is determined whether or not the flag PAF1 is set to "0", i.e. whether or not the output voltage PVO2 from the upstream O2 sensor 16 shows a lean value. If the answer is affirmative (YES), i.e. if PAF1=0 holds (the output voltage PVO2 shows a lean value), the program proceeds to a step S33.

At the step S33, the flag PAF2 is set to "0", and then at a step S34, the set value CDLY1 is reset to the delay time TDR1, followed by the program proceeding to a step S35.

At the step S35, a present value of the correction coefficient KO2 is calculated by adding a proportional term PR to the immediately preceding value of the correction coefficient KO2 by the use of the following equation (4):

$$KO2=KO2+PR \quad (4)$$

Then, limit-checking of the correction coefficient KO2 calculated as above is carried out at a step S36, and a value KREF0 (average value of the correction coefficient KO2 calculated during idling of the engine) and a value KREF1 (average value of the correction coefficient KO2 calculated when the engine is not idling) are calculated at a step S37. Then, the program proceeds to the step S28, followed by terminating the program.

If the answer to the question of the step S32 is negative (NO), i.e. if the output voltage PVO2 from the upstream O2 sensor 16 shows a rich value (PAF1=1), the program proceeds to a step S38, wherein the flag PAF2 is set to "1", and then at a step S39, the set value CDLY1 is reset to the delay time TDL1, followed by the program proceeding to a step S40.

At the step S40, a present value of the correction coefficient KO2 is calculated by subtracting a proportional term PL from the immediately preceding value of the correction coefficient KO2 by the use of the following equation (5):

$$KO2=KO2-PL \quad (5)$$

Then, the steps S36, S37 and S28 are sequentially carried out, followed by terminating the program. In this way, the timing of generation of the integral term I and the proportional term PR or PL of the correction coefficient KO2 is calculated based on the output voltage PVO2 from the upstream O2 sensor 16.

Figure 3:
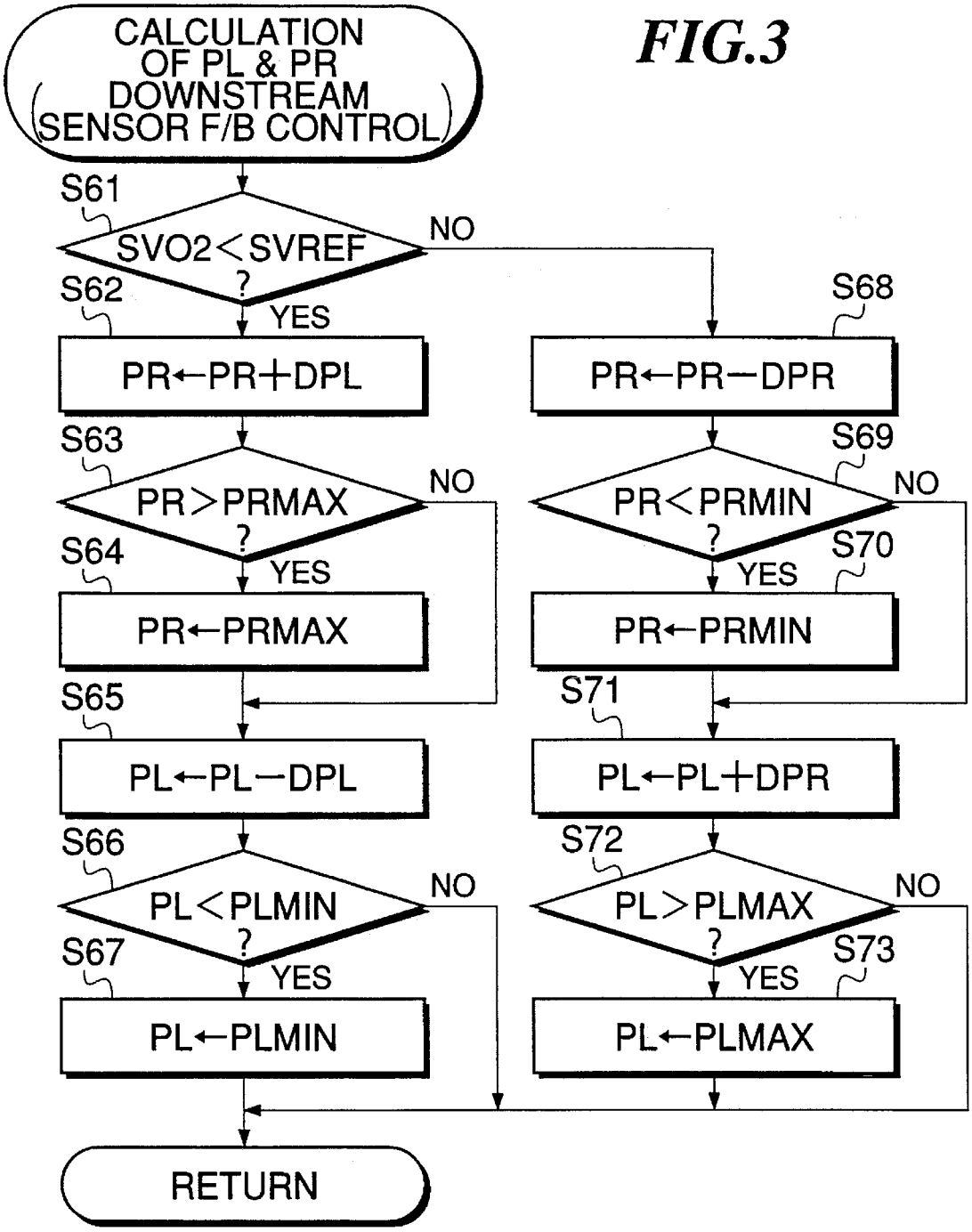
FIG. 3 is a flowchart showing a program for calculating parameter values PR and PL for use in air-fuel ratio feedback control, based on an output from a downstream O2 sensor.

FIG. 3 shows a program for calculating the proportional terms PL and PR which are employed at the step S35 and S40 in FIG. 2B, in response to the output voltage SVO2 from the downstream O2 sensor 17. This program is executed by the CPU **5*b*** at predetermined fixed time intervals (e.g. 5 msec) when the engine is operating in the air-fuel ratio feedback control region for carrying out air-fuel ratio feedback control based on the downstream O2 sensor output SVO2.

Basically, the PR and PL values are calculated based on the output voltage SVO2 from the downstream O2 sensor 17 (feedback control based on the downstream O2 sensor). However, when the feedback control based on the downstream O2 sensor output cannot be executed (e.g. during idling of the engine, when the downstream O2 sensor 17 is inactive, etc.), predetermined values or the learned values calculated during the feedback control are applied as the PR and PL values.

At a step S61, it is determined whether or not the downstream O2 sensor output voltage SVO2 is lower than a reference value SVREF (e.g. 0.45 V). If SVO2<SVREF holds, the program proceeds to a step S62, wherein a correction term DPL applied when the air-fuel ratio is determined to be lean is added to the PR value. If the PR value after the addition exceeds an upper limit value PRMAX at a step S63, the PR value is set to the upper limit value PRMAX at a step S64. At the following step S65, the correction term DPL is subtracted from the PL value. If the PL value after the subtraction is smaller than a lower limit value PLMIN at a step S66, the PL value is set to the lower limit value PLMIN at a step S67.

On the other hand, if the answer to the question of the step S61 is negative (NO), i.e. if SVO2≧SVREF holds, the program proceeds to a step S68, wherein a correction term DPR applied when the air-fuel ratio is determined to be rich is subtracted from the PR value. If it is determined at a step S69 that the PR value after the subtraction is smaller than a lower limit value PRMIN, the PR value is set to the lower limit value PRMIN at a step S70. Then, at a step S71, the correction term DPR is added to the PL value. If it is determined at a step S72 that the PL value after the addition is larger than an upper limit value PLMAX, the PL value is set to the upper limit value PLMAX at a step S73.

According to the above processing, during a time period over which SVO2<SVREF holds, the PR value is increased within a range between the lower and upper limit values PRMIN and PRMAX, while the PL value is decreased within a range between the lower and upper limit values PLMIN and PLMAX. On the other hand, during a time period over which SVO2≧SVREF holds, the PR value is decreased and the PL value is increased within the above-mentioned respective ranges.

Figure 4:
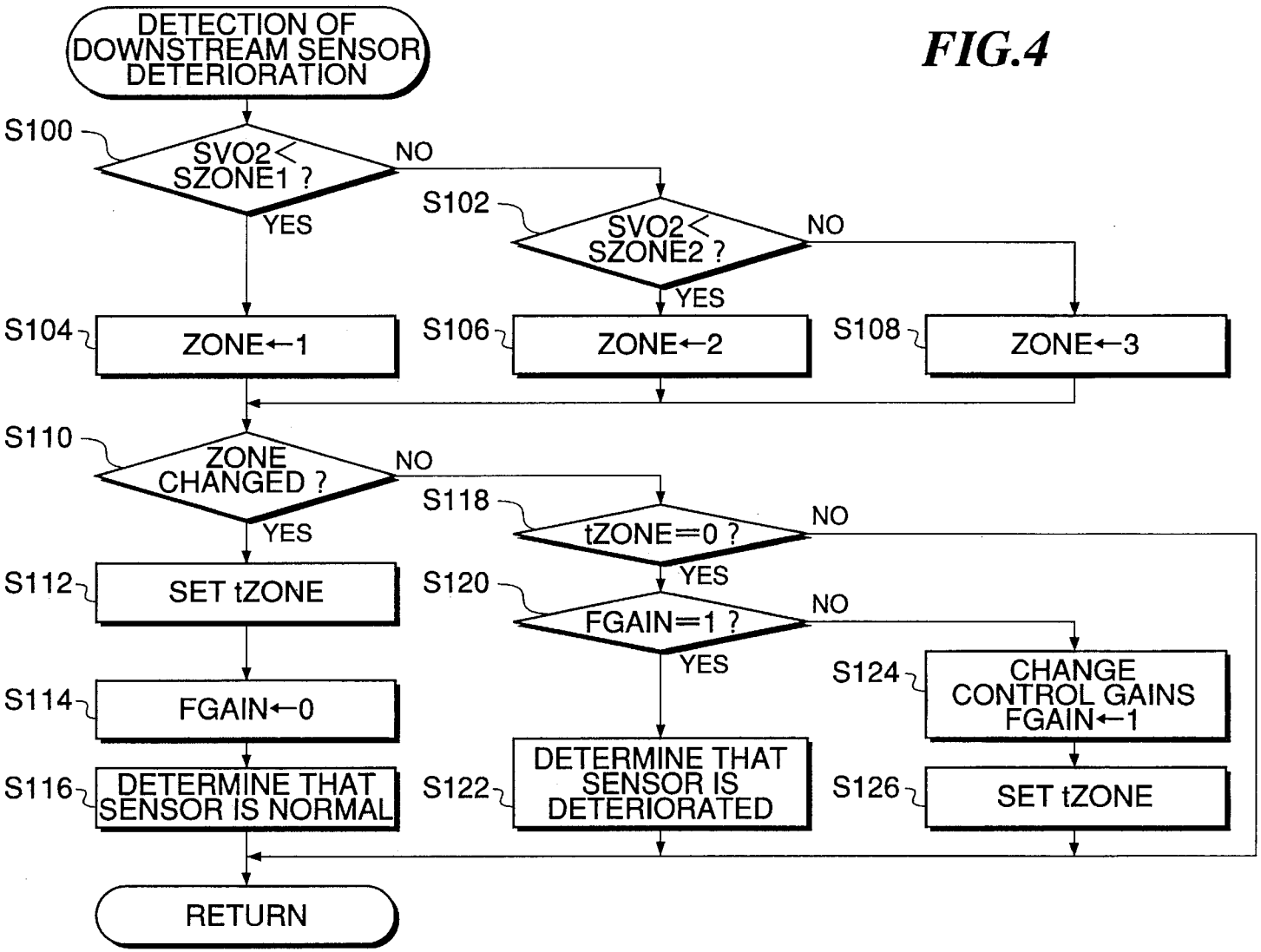
FIG. 4 is a flowchart showing a program for detecting deterioration of the downstream O2 sensor.

FIG. 4 shows a program for detecting deterioration of the downstream O2 sensor 17, which is executed by the CPU **5*b* in synchronism with execution of the program of FIGS. 2A and 2B**, etc.

First, at a step S100, it is determined whether or not the downstream O2 sensor output SVO2 is smaller than a first zone reference value SZONE1 (e.g. 0.4 V), and if SVO2≧SZONE1 holds, it is determined at a step S102 whether or not the downstream O2 sensor output SVO2 is smaller than a second zone reference value SZONE2 (e.g. 0.6 V). If it is determined that SVO2<SZONE1 holds, a zone parameter ZONE indicating a range where the SVO2 value is present is set to "1" at a step S104. On the other hand, if it is determined that SZONE1≦SVO2<SZONE2 holds, the zone parameter ZONE is set to "2" at a step S106, while if SVO2≧SZONE2 holds, the zone parameter ZONE is set to "3" at a step S108 (see FIG. 6A).

At the following step S110, it is determined whether or not the value of the zone parameter ZONE has been changed. If it has been changed, the program proceeds to a step S112, wherein a down-counting timer tZONE is set to a predetermined time period TZONE (e.g. 120 sec) and started. Then, at a step S114, a gain flag FGAIN is set to "0". The gain flag FGAIN is set to "1" when a control gain for the feedback control based on the downstream O2 sensor output SVO2, i.e. the correction terms DPL and DPR used in the FIG. 3 program, should be changed. Then, it is determined at a step S116 that the downstream O2 sensor 17 is normal, followed by terminating the program.

If it is determined at the step S110 that the value of the zone parameter ZONE has not been changed, it is determined at a step S118 whether or not the count value of the timer tZONE is equal to "0". Immediately after the change of the value of the parameter ZONE, tZONE>0 holds, and accordingly the program is immediately terminated. On the other hand, if the predetermined time period TZONE has elapsed after the change of the value of the parameter ZONE to satisfy tZONE=0, the program proceeds to a step S120, wherein it is determined whether or not the gain flag FGAIN is set to "1". In the first execution of the step S120, the flag FGAIN is equal to "0", and accordingly the program proceeds to a step S124, wherein the gain flag FGAIN is set to "1", and then the timer tZONE is set to the predetermined time period TZONE and started at a step S126, followed by terminating the program.

After execution of the step S126, a state where the value of the zone parameter ZONE has not been changed continues over the predetermined time period TZONE, the answer to the question of the step S118 becomes affirmative (YES). Since on this occasion FGAIN=1 holds, it is determined at a step S122 that the downstream O2 sensor 17 is deteriorated, followed by terminating the program.

Figure 5:
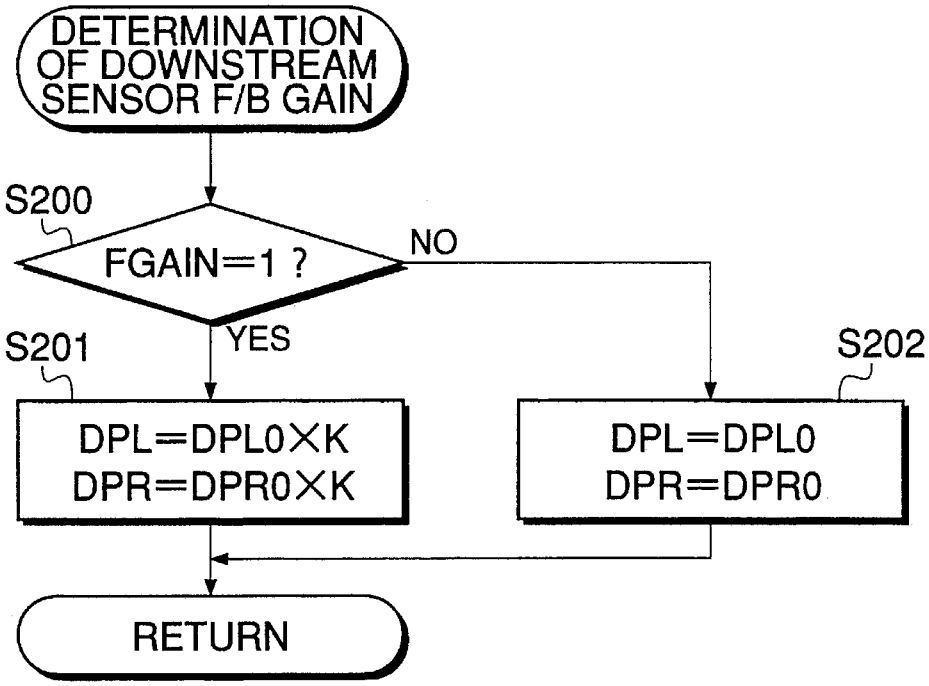
FIG. 5 is a flowchart showing a program for determining parameter values (control gains) which are employed in the FIG. 3 program.

FIG. 5 shows a program for determining the control gain for the feedback control based on the downstream O2 sensor output SVO2, i.e. the correction terms DPL and DPR employed in the FIG. 3 program. This program is executed immediately before the execution of the FIG. 3 program.

First, at a step S200, it is determined whether or not the gain flag FGAIN is set to "1". If FGAIN=0 holds, the correction terms DPL and DPR are set to predetermined values DPL0 and DPR0, respectively, at a step S202, followed by terminating the program. On the other hand, if FGAIN=1 holds, the correction terms DPL and DPR are set to products obtained by multiplying the respective predetermined values DPL0 and DPR0 by a predetermined coefficient K (e.g. 1.3), at a step S201. Thus, if the gain flag FGAIN is set to "1", the correction terms DPL and DPR are set to larger values, i.e. the control gain is increased relative to values set when the flag FGAIN is set to "0".

In this processing of the embodiment, although the correction terms DPL and DPR are determined by multiplying the respective predetermined values DPL0 and DPR0 by the predetermined value K (larger than 1.0), this is not limitative, but the correction terms DPL and DPR may be set to respective predetermined values DPL1 and DPR1, which are larger than 1.0.

The processing of FIGS. 4 and 5 will be further described with reference to FIG. 6.

First, when the downstream O2 sensor output SVO2 increases near a time point t1 so that the value of the parameter ZONE changes from "1" to "2", the timer tZONE is set to the predetermined time period TZONE. When the sensor output SVO2 subsequently becomes steady and the count value of the timer tZONE decreases to "0" at a time point t2, the gain flag FGAIN is changed from "0" to "1", and further the timer tZONE is set to the predetermined time period TZONE. Since the gain flag FGAIN is thus set to "1", the correction terms DPL and DPR are changed to the respective larger values to increase the feedback control gain, and accordingly the air-fuel ratio is more quickly changed in the rich direction or the lean direction than when the flag FGAIN is set to "0". As a result, the sensor output SVO2 increases as indicated by the solid line in FIG. 6A, whereby the value of the parameter ZONE is changed from "2" to "3" at a time point t3. Thus, it is determined that the downstream O2 sensor 17 is normal (at the steps S110 and S116 in FIG. 4).

Figures 6A, 6B, 6C, 6D:
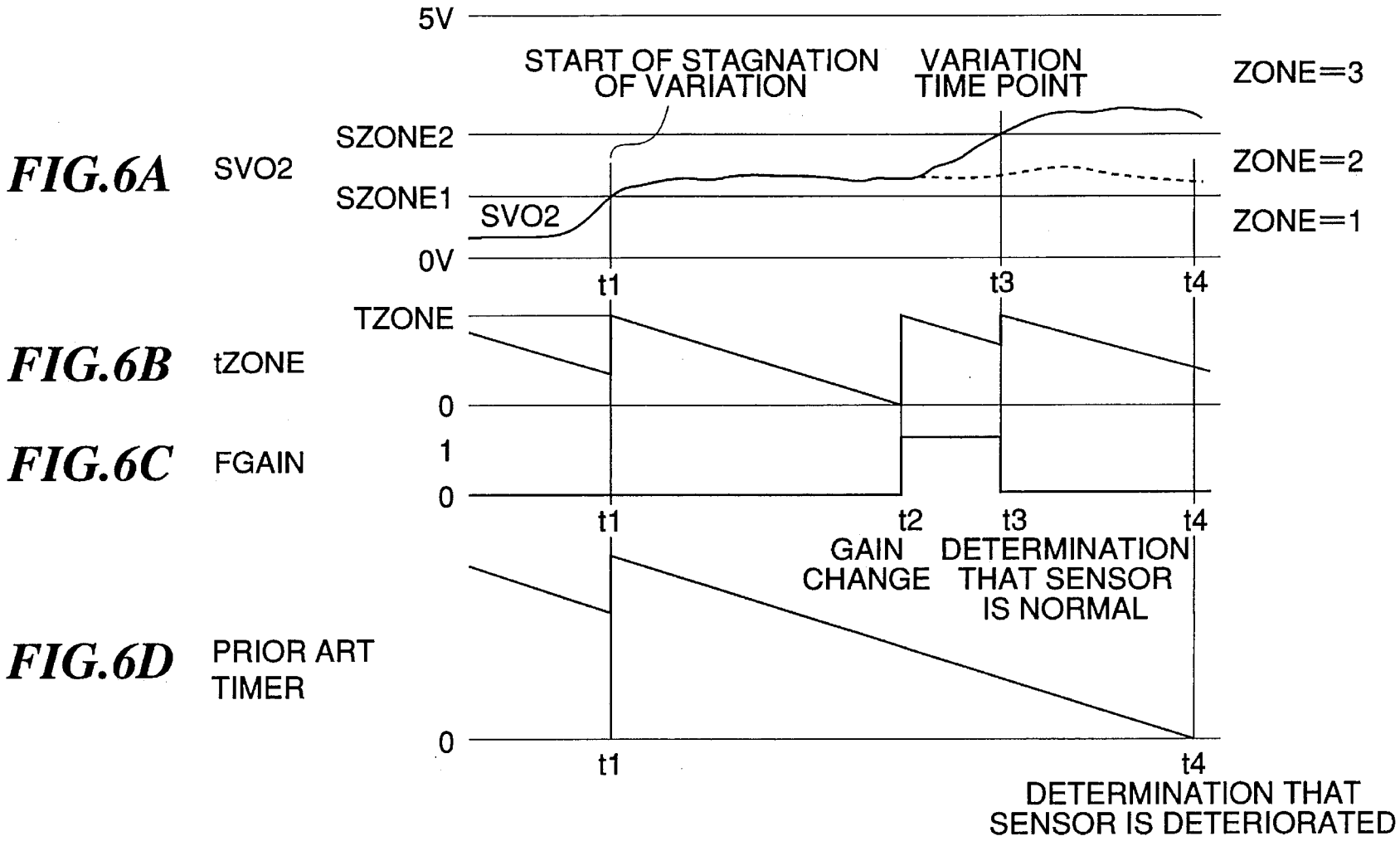
FIGS. 6A–6D are a timing chart useful in explaining the processings of FIGS. 4 and 5.

On the other hand, if the sensor output SVO2 remains almost unchanged over the predetermined time period TZONE even if the control gain is increased, though not shown in FIG. 6A, it is determined that the O2 sensor 17 is not responsive to the resulting change in the air-fuel ratio, and therefore it is determined that the downstream O2 sensor 17 is deteriorated.

As indicated by the broken line in FIG. 6A, the output SVO2 from the downstream O2 sensor can remain almost unchanged continuously even if the O2 sensor is functioning normally. On such an occasion, according to the conventional deterioration-detecting method which does not change the control gain, the downstream O2 sensor which is operating normally is erroneously determined to be deteriorated, as shown in FIG. 6D. According to the present invention, however, such an erroneous determination can be prevented, to thereby improve the accuracy of detection of deterioration of the downstream O2 sensor deterioration.

Although in the present embodiment, if the flag FGAIN is set to "1", the correction terms DPL and DPR employed in the processing of FIG. 3 are increased according to the program of FIG. 5, this is not limitative. In place of increasing the correction terms DPL and DPR, the proportional terms PL and PR calculated by the program of FIG. 3 may be increased.

Figure 7:
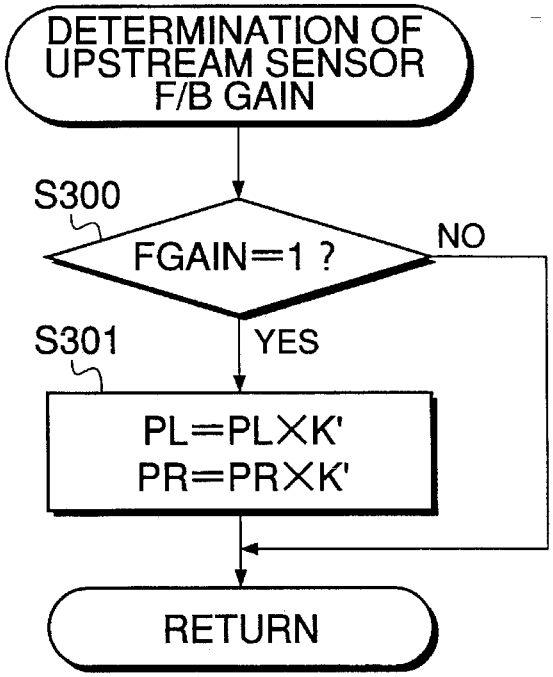
FIG. 7 is a flowchart showing a program for determining parameter values (control gains) for use in air-fuel ratio feedback control, based on an upstream O2 sensor.

More specifically, the increase of the proportional terms PL and PR may be carried out according to a program of FIG. 7. First, it is determined at a step S300 whether or not the flag FGAIN is set to "1", and if the answer is affirmative (YES), the proportional terms PL and PR are multiplied by a predetermined coefficient K' (>1), at a step S301. On the other hand, if the flag FGAIN is set to "0", the program is immediately terminated. By executing this program immediately after termination of the execution of the FIG. 3 program, when the flag FGAIN is set to "1", the PL and PR terms are set to values larger by the predetermined coefficient K' than values assumed when the flag FGAIN is set to "0".

Alternatively, both the FIG. 5 processing and the FIG. 6 processing may be employed together.

What is claimed is:

1. In an air-fuel ratio sensor deterioration-detecting system for an internal combustion engine having an exhaust system, a catalytic converter arranged in said exhaust system, first and second air-fuel ratio sensors arranged in said exhaust system at respective locations upstream and downstream of said catalytic converter, first air-fuel ratio control parameter-calculating means for calculating a value of a first control parameter, based on an output from said second air-fuel ratio sensor, air-fuel ratio control means for executing air-fuel ratio feedback control such that an air-fuel ratio of an air-fuel mixture to be supplied to said engine is controlled based on the calculated value of said first control parameter, second air-fuel ratio control parameter-calculating means for calculating a value of a second control parameter to be used for calculating a value of said first control parameter, based on said output from said second air-fuel ratio sensor, and deterioration-determining means for determining whether said second air-fuel ratio sensor is deteriorated, based on said output from said second air-fuel ratio sensor, the improvement wherein:

said deterioration-determining means comprises increasing means for increasing a value of at least one of said first and second control parameters when a variation in said output from said second air-fuel ratio sensor is small during execution of said air-fuel ratio feedback control by said air-fuel ratio control means, and determining means for determining that said second air-fuel ratio sensor is deteriorated when said variation in said output from said second air-fuel ratio sensor is continuously small over a predetermined time period after the value of said at least one of said first and second control parameters has been increased.

2. An air-fuel ratio sensor deterioration-detecting system as claimed in claim 1, wherein said increasing means increases the value of said at least one of said first and second control parameters when said output from said second air-fuel ratio sensor continuously remains within a predetermined range over a predetermined time period during execution of said air-fuel ratio feedback control by said air-fuel ratio control means.

3. An air-fuel ratio sensor deterioration-detecting system as claimed in claim 1 or 2, wherein said determining means determines that said second air-fuel ratio sensor is deteriorated when said output from said second air-fuel ratio sensor, which has been increased by said increasing means, continuously remains within a predetermined range over a predetermined time period.

4. An air-fuel ratio sensor deterioration-detecting system as claimed in claim 1, including zone-determining means for determining which of a plurality of predetermined zones said output from said second air-fuel ratio sensor falls in, and wherein said increasing means increases the value of said at least one of said first and second control parameters when said output from said second air-fuel ratio sensor continuously remains within one of said plurality of said predetermined zones over a predetermined time period.

5. An air-fuel ratio sensor deterioration-detecting system as claimed in claim 4, wherein said determining means determines that said second air-fuel ratio sensor is deteriorated when said output from said second air-fuel ratio sensor, which has been increased by said increasing means, continuously remains within one of said plurality of said predetermined zones over a predetermined time period.

6. In an air-fuel ratio sensor deterioration-detecting system for an internal combustion engine having an exhaust system, a catalytic converter arranged in said exhaust system, first and second air-fuel ratio sensors arranged in said exhaust system at respective locations upstream and downstream of said catalytic converter, air-fuel ratio control parameter-calculating means for calculating a value of a control parameter, based on an output from said second air-fuel ratio sensor, air-fuel ratio control means for executing air-fuel ratio feedback control such that an air-fuel ratio of an air-fuel mixture to be supplied to said engine is controlled based on the calculated value of said control parameter, and deterioration-determining means for determining whether said second air-fuel ratio sensor is deteriorated, based on said output from said second air-fuel ratio sensor, the improvement wherein:

said deterioration-determining means comprises increasing means for increasing the value of said control parameter when a variation in said output from said second air-fuel ratio sensor is below a predetermined value during execution of said air-fuel ratio feedback control by said air-fuel ratio control means, and determining means for determining that said second air-fuel ratio sensor is deteriorated when said variation in said output from said second air-fuel ratio sensor continuously remains below said predetermined value over a predetermined time period after the value of said control parameter has been increased.

* * * * *